US006056055A

United States Patent [19]

Falconer et al.

[11] Patent Number: 6,056,055

[45] Date of Patent: May 2, 2000

[54] DOWNHOLE LUBRICATOR FOR INSTALLATION OF EXTENDED ASSEMBLIES

[75] Inventors: Graeme Falconer, Footdee; John Morrison, Bridge of Don, both of United Kingdom

[73] Assignee: Baker Hughes Incorporated, Houston, Tex.

[21] Appl. No.: 09/109,521

[22] Filed: Jul. 2, 1998

[30] Foreign Application Priority Data

Jul. 2, 1997 [GB] United Kingdom ..... 9714015

[51] Int. Cl.[7] ..... E21B 23/00; E21B 43/116

[52] U.S. Cl. ..... 166/297; 166/381

[58] Field of Search ..... 166/297, 381, 166/386, 387, 70, 379

[56] References Cited

U.S. PATENT DOCUMENTS

| | | |
|---|---|---|
| Re. 25,471 | 11/1963 | Fredd . |
| 3,040,811 | 6/1962 | Pistole et al. . |
| 4,116,272 | 9/1978 | Barrington . |
| 4,253,525 | 3/1981 | Young . |
| 4,273,186 | 6/1981 | Pearce et al. . |
| 4,311,197 | 1/1982 | Hushbeck . |
| 4,368,871 | 1/1983 | Young . |
| 4,378,850 | 4/1983 | Barrington . |
| 4,415,036 | 11/1983 | Carmody et al. . |
| 4,427,071 | 1/1984 | Carmody . |
| 4,444,268 | 4/1984 | Barrington . |
| 4,448,254 | 5/1984 | Barrington . |
| 4,476,933 | 10/1984 | Brooks . |
| 4,522,370 | 6/1985 | Noack et al. . |
| 4,531,587 | 7/1985 | Fineberg . |
| 4,579,174 | 4/1986 | Barrington . |
| 4,595,060 | 6/1986 | Beck . |
| 4,603,742 | 8/1986 | Wong et al. . |
| 4,618,000 | 10/1986 | Burris, II . |
| 4,619,325 | 10/1986 | Zunkel . |
| 4,624,317 | 11/1986 | Barrington . |
| 4,655,288 | 4/1987 | Burris, II et al. . |
| 4,665,991 | 5/1987 | Manke . |
| 4,711,305 | 12/1987 | Ringgenberg . |

(List continued on next page.)

FOREIGN PATENT DOCUMENTS

| | | |
|---|---|---|
| 2286840 | 8/1995 | United Kingdom . |
| WO 97/27382 | 7/1997 | WIPO . |

OTHER PUBLICATIONS

Alexander Sas–Jawoski II, et al., "Coiled tubing 1995 update: Production applications," *World Oil*, Jun. 19095, 97–105.

Tim Walker, et al., *Downhole Swab Valve Aids in Underbalanced Completion of North Sea Well*, SPE 30421, Society of Petroleum Engineers, Inc., 1995, 3 pages.

Tim Walker, et al., *Underbalanced Completions Improve Well Safety and Productivity*, World Oil, Nov. 1995, 4 pages.

*Primary Examiner*—Hoang Dang

*Attorney, Agent, or Firm*—Duane, Morris & Heckscher LLP

[57] ABSTRACT

The wellbore is adapted for use as a lubricator for assembly of lengthy installations. The subsurface safety valve is used in conjunction with a nipple inserted into the wellbore and held in position by a packer. A plug is part of the nipple assembly. Upon setting of the packer, two barriers downhole are created to facilitate assembly of tools such as a perforating gun in the wellbore behind two barriers. The tool, such as a perforating gun, has a running tool below it which engages the plug. When the assembly is made up in the wellbore, the plug is engaged by the running tool and released from the nipple. The plug can then be advanced through the open subsurface safety valve to the proper location for deployment of a perforating gun, for example. Upon completion of the downhole procedures, such as perforating, the tools are brought uphole and the plug is sealingly relatched in the nipple, thus recreating the necessary two barriers to permit opening the wellbore at the surface to remove the assembly of the downhole tools and the running tool. The plug can be reengaged as many times as necessary for installation of a variety of equipment. The nipple can then also be removed after the packer is released.

20 Claims, 20 Drawing Sheets

U.S. PATENT DOCUMENTS

| | | | |
|---|---|---|---|
| 4,825,902 | 5/1989 | Helms . | |
| 4,846,281 | 7/1989 | Clary et al. . | |
| 4,856,558 | 8/1989 | Kardos . | |
| 4,903,775 | 2/1990 | Manke . | |
| 4,940,095 | 7/1990 | Newman | 166/378 |
| 4,986,358 | 1/1991 | Leuders et al. . | |
| 5,025,861 | 6/1991 | Huber et al. | 166/297 |
| 5,159,949 | 11/1992 | Prescott et al. . | |
| 5,201,371 | 4/1993 | Allen . | |
| 5,203,410 | 4/1993 | Cobb et al. . | |
| 5,213,125 | 5/1993 | Leu . | |
| 5,320,176 | 6/1994 | Naquin et al. . | |
| 5,366,014 | 11/1994 | George . | |
| 5,411,096 | 5/1995 | Akkerman . | |
| 5,465,786 | 11/1995 | Akkerman . | |
| 5,503,224 | 4/1996 | Field . | |
| 5,509,481 | 4/1996 | Huber et al. . | |
| 5,529,127 | 6/1996 | Burleson et al. . | |
| 5,603,379 | 2/1997 | Henke et al. . | |
| 5,701,957 | 12/1997 | Williamson et al. . | |
| 5,803,157 | 9/1998 | Myers, Jr. et al. | 166/297 |
| 5,848,646 | 12/1998 | Huber et al. | 166/297 |
| 5,857,523 | 1/1999 | Edwards | 166/374 |

DOWNHOLE LUBRICATOR FOR INSTALLATION OF EXTENDED ASSEMBLIES

FIELD OF THE INVENTION

The field of this invention relates to installation of lengthy assemblies into a live well while providing a dual shut-off capability in a technique which does not require lengthy surface-mounted lubricators.

BACKGROUND OF THE INVENTION

In many applications, downhole assemblies which are quite lengthy need to be inserted into live wells. One technique that has been used in the past to accomplish this is to assemble a very tall lubricator. A lubricator is an isolation device mounted at the surface, which allows, through sequential valve operation, the assurance of a chamber which is at least doubly isolated from wellbore pressure, so that lengthy downhole assemblies can be assembled therein. Once the lengthy assemblies are fully put into the lubricator, the lubricator is isolated at the top around tubing or wireline and opened at the bottom. The tubing or wireline is then used to advance the assembly into the live well. One of the drawbacks of such a technique is that lubricators, which are 40 to 100 feet long, must be erected on the rig to accommodate lengthy bottomhole assemblies. This is time-consuming and expensive and further presents additional safety hazards for personnel who must be present near the top end of the lubricator to facilitate the insertion of the downhole assembly into the lubricator.

Regulations require that at least two positive shut-offs be provided from the well pressures at the surface where the downhole assembly is put together. The subsurface safety valve, which is a standard item on all the wells, is one such barrier. In some situations where the dual barrier can be required is if an existing well needs to be perforated at another location. In the past, large lubricators have been built at the rig floor to accommodate a gun assembly which could be fairly lengthy.

One of the objectives of the present invention is to eliminate the need for building lengthy lubricators at the rig floor by employing a portion of the wellbore for assembly of lengthy downhole assemblies such as perforating guns. Thus, in accomplishing the objective, the present invention provides for a second barrier such as a plug in addition to the subsurface safety valve. This additional barrier can be manipulated out of the way to allow the additional downhole function to be performed and, at the same time, the plug can be repositioned so that the assembly, which has been put together in the wellbore, can be brought up above the subsurface safety valve. Once again, two isolation devices will exist to permit the disassembly of the lengthy downhole assembly still in the wellbore. Thereafter, the upper barrier can be removed from the wellbore to facilitate future operations.

The prior art illustrates numerous styles of subsurface valves primarily used for safety shut-off purposes. Some assemblies involve singular valves and others involve dual valves. Typical of such art are U.S. Pat. Nos. Reissue 25,471; 4,116,272; 4,253,525; 4,273,186; 4,311,197; 4,368,871; 4,378,850; 4,444,268; 4,448,254; 4,476,933; 4,522,370; 4,579,174; 4,595,060; 4,603,742; 4,618,000; 4,619,325; 4,624,317; 4,655,288; 4,665,991; 4,711,305; 4,846,281; 4,903,775; 4,415,036; 4,427,071; 4,531,587; 4,825,902; 4,856,558; 4,986,358; 5,201,371; 5,203,410; 5,213,125; 5,411,096; and 5,465,786. This subject has also been written about in the November 1995 issue of World Oil in an article by Tim Walker and Mark Hopmann, entitled "Underbalanced Completion Improved Well Safety and Productivity," and in an SPE, Paper No. 304 Q1 by Tim Walker and Mark Hopmann, entitled "Downhole Swab Valve Aids In Underbalanced Completion of North Sea Well." This SPE paper was presented in the 1995 meeting held in Aberdeen.

The prior art just described reveals various components of downhole safety valve systems which include flapper-type and ball-type valves. What has been lacking is a system that is versatile and reliable as the system that is the present invention which facilitates the assembly of long downhole assemblies in the wellbore. The new system is flexible and can be readily installed when using extended assemblies in conjunction with wireline coil tubing or work string assemblies.

SUMMARY OF THE INVENTION

The wellbore is adapted for use as a lubricator for assembly of lengthy installations. The subsurface safety valve is used in conjunction with a nipple inserted into the wellbore and held in position by a packer. A plug is part of the nipple assembly. Upon setting of the packer, two barriers downhole are created to facilitate assembly of tools such as a perforating gun in the wellbore behind two barriers. The tool, such as a perforating gun, has a running tool below it which engages the plug. When the assembly is made up in the wellbore, the plug is engaged by the running tool and released from the nipple. The plug can then be advanced through the open subsurface safety valve to the proper location for deployment of a perforating gun, for example. Upon completion of the downhole procedures, such as perforating, the tools are brought uphole and the plug is sealingly relatched in the nipple, thus recreating the necessary two barriers to permit opening the wellbore at the surface to remove the assembly of the downhole tools and the running tool. The plug can be reengaged as many times as necessary for installation of a variety of equipment. The nipple can then also be removed after the packer is released.

DETAILED DESCRIPTION OF THE DRAWINGS

FIGS. 6*a*–6*g* illustrate the nipple assembly with the running tool in the run-in position.

FIGS. 7*a*–7*g* illustrate further advancement of the running tool to equalize pressure on the plug.

FIGS. 8*a*–8*g* illustrate further advancement of the running tool indicating a travel limit reached for the outer sleeve.

FIGS. 9*a*–9*g* illustrate further advancement of the running tool just prior to release of the plug latch.

FIGS. 10*a*–10*g* indicate further advancement of the running tool and collet assembly so as to retain the outer sleeve as the plug latch is about to be turned.

FIGS. 11*a*–11*g* illustrate the further advancement of the running tool and collet assembly, with the plug latch fully rotated and full setdown weight.

FIGS. 12*a*–12*g* illustrate the plug latch fully turned just prior to application of a pickup force on the running tool so as to facilitate advancement of the plug downhole.

FIGS. 13*a*–13*g* show the fully released position allowing the plug to move downhole.

DETAILED DESCRIPTION OF THE PREFERRED EMBODIMENT

Figure 1:
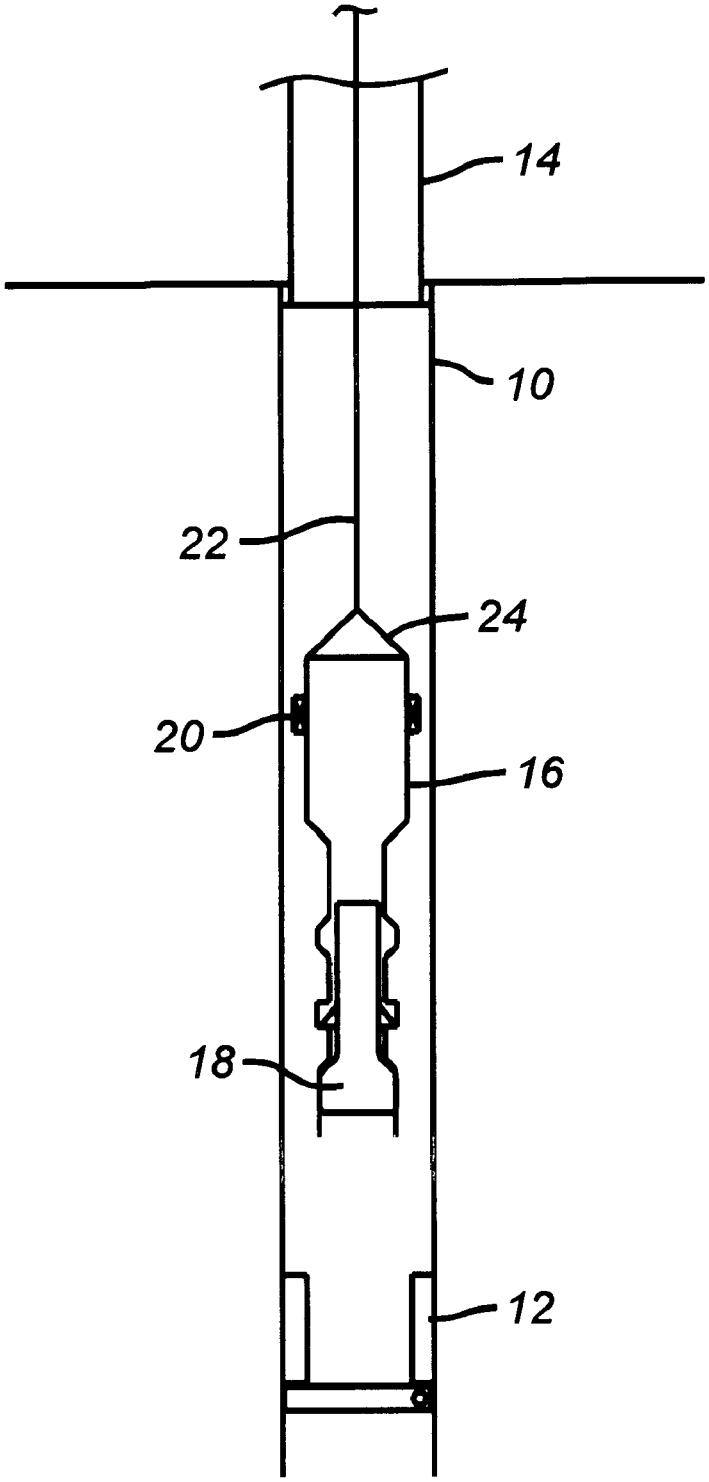
FIG. 1 is a schematic view of the wellbore, showing the installation of the nipple with the plug and the packer assembly on the nipple.
Figure 2:
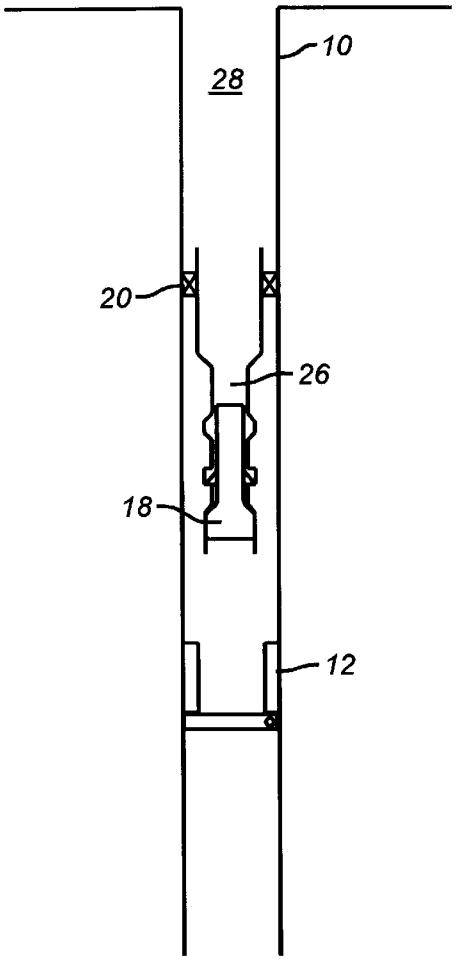
FIG. 2 is a view of FIG. 1, with the nipple assembly in position and the packer set, thus forming a second barrier above the subsurface safety valve.

The operation of the apparatus and method of the present invention is illustrated schematically in FIGS. 1–5. In FIG. 1, the wellbore 10 has a subsurface safety valve 12. A lubricator or snubbing unit 14 can be mounted on top of the wellbore 10. An assembly of a nipple 16, a plug 18, and a packer 20 are installed through the lubricator 14 with, for example, a wireline 22. The assembly further includes the necessary setting tool 24 to actuate the packer 20. The packer 20 and setting tool 24 are well-known in the art. As shown in FIG. 1, the assembly is suspended above the subsurface safety valve 12. As shown in FIG. 2, the packer 20 has been set against the wellbore 10 and the setting tool 24 removed with the wireline 22. The plug 18 is part of the assembly with the nipple 16 when it is run into the wellbore on the wireline 22. It should be noted that alternative techniques for getting the assembly of the packer 20, the nipple 16, and the plug 18 to the desired position can be employed without departing from the spirit of the invention. With the plug 18 now in position, where it seals off the passage 26, the pressure in the wellbore 10 can be relieved through the lubricator 14 which was used to install the nipple 16. The upper region of the wellbore 28 is now available for assembling the downhole assembly within the wellbore 10. It should also be noted that the nipple 16 can be installed at any given time and may not necessarily require a lubricator 14 for insertion into the wellbore depending on the timing of its installation and the actual wellbore conditions at the time of its installation.

Figure 3:
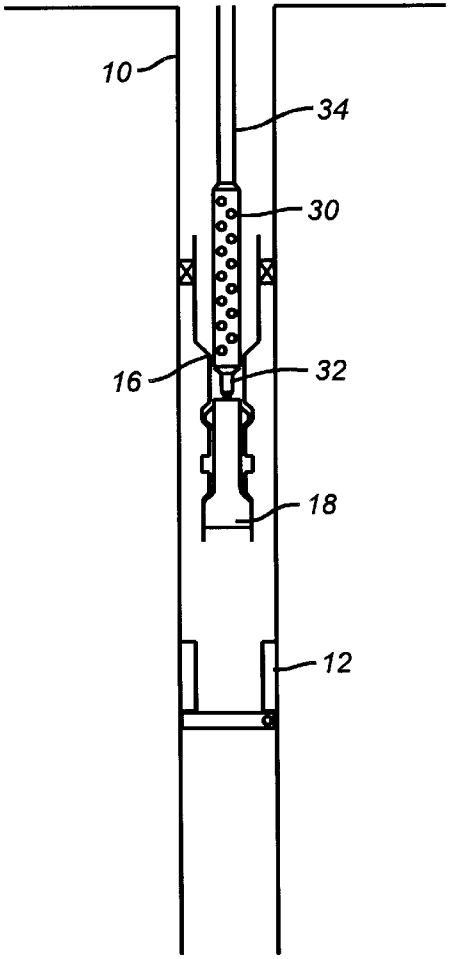
FIG. 3 is a schematic view of a tool assembled in the wellbore above the two closed barriers.
Figure 5:
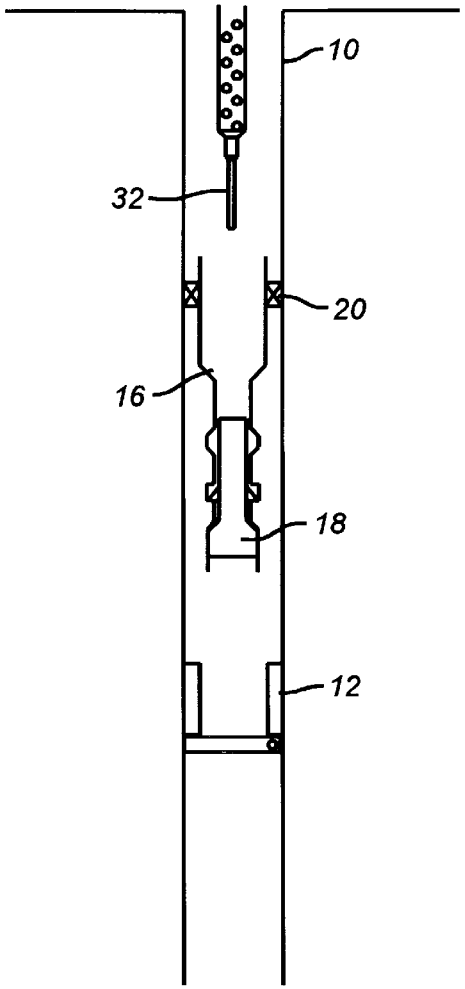
FIG. 5 is a schematic representation showing the retrieval of the downhole tool through the subsurface safety valve until the plug catches in the nipple to recreate the two barriers to allow the assembly of the downhole tool assembly within the wellbore.
Figure 4:
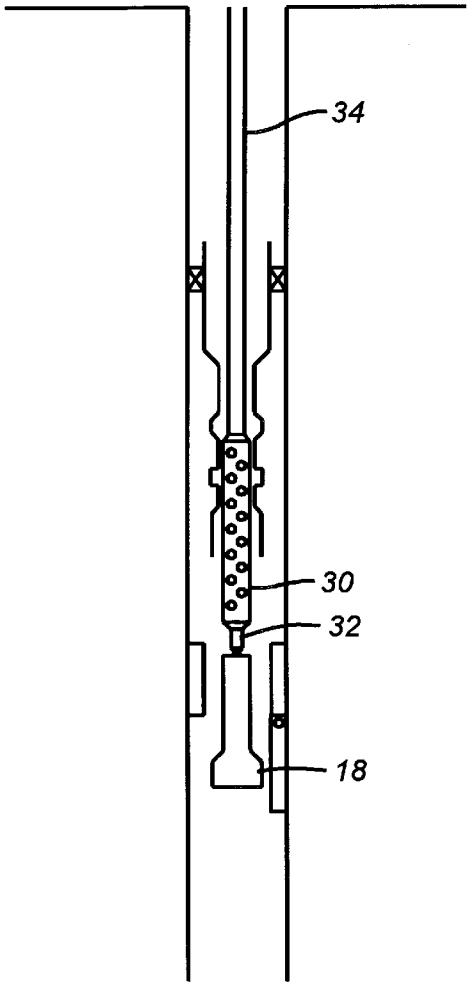
FIG. 4 illustrates the release of the plug from the nipple and the passage of the tool through the nipple and the opened subsurface safety valve for the completion of the downhole operation.

With the upper region 28 now depressurized and isolated by subsurface safety valve 12 and plug 18, a downhole assembly such as a perforating gun 30 with a running tool 32 at the bottom of it can be run into the wellbore 10, as shown in FIG. 3. The running tool 32 latches into the plug 18 so that the plug 18 can ultimately be released from the nipple 16. Once the plug 18 is latched with the running tool 32 and the top of the wellbore 10 is closed off through a snubbing unit such as 14, the coiled tubing 34 is advanced into the wellbore 10, allowing the gun 30 and the plug 18 to move through passage 26 to the desired position in the wellbore, as shown in FIG. 4. In the situation as shown in FIG. 4 where a gun 30 is used, the gun is now in position for firing and it is fired with the plug 18 still appended to the running tool 32. At the completion of the perforating operation, the perforating gun and plug are retrieved uphole, as shown in FIG. 5. Eventually, the plug 18 reseats in the nipple 16 and the running tool 32 releases from the plug 18 to allow the gun 30 to be in the upper region 28 of the wellbore 10, with two positive closures below. Those closures are the subsurface safety valve 12, which is closed from the surface after the plug 18 passes through it, and the plug 18 seated in the nipple 16, which constitutes the other downhole barrier. At that point, the upper region 28 is again depressurized from the surface and the gun assembly 30 is dismantled using the wellbore 10 as the lubricator yet again. Thereafter, the nipple assembly 16 can be removed with a known retrieving tool which is inserted into the wellbore 10 to release the packer 20 so that the nipple 16 with the plug 18 can also be removed from the wellbore.

Those skilled in the art will appreciate that other types of assemblies than the perforating gun 30 can be used with this technique. Other types of delivery systems for the assembly can be used than the coiled tubing illustrated in FIGS. 3–5 without departing from the spirit of the invention. This procedure can also be repeated several times for different reasons with the nipple assembly 16 being used at different elevations as the second barrier in conjunction with a preexisting downhole subsurface safety valve 12.

Referring now to FIGS. 6*a*–*g*, the major components of the plug 18 and nipple assembly 16 and the running tool 32 will be described more fully to explain in detail how the steps illustrated in FIGS. 1–5 are accomplished.

Figure 6A:
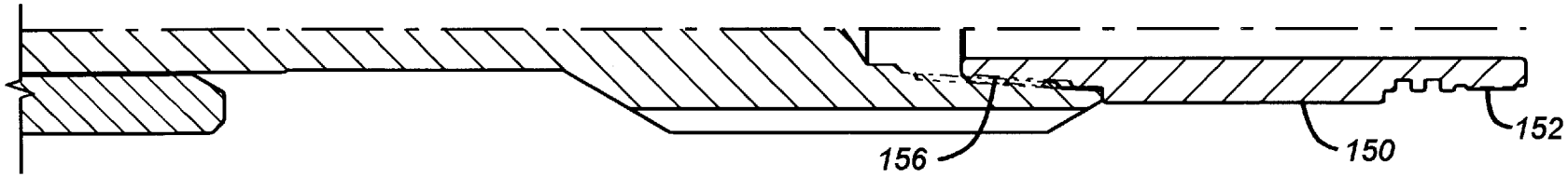
Figure 6B:
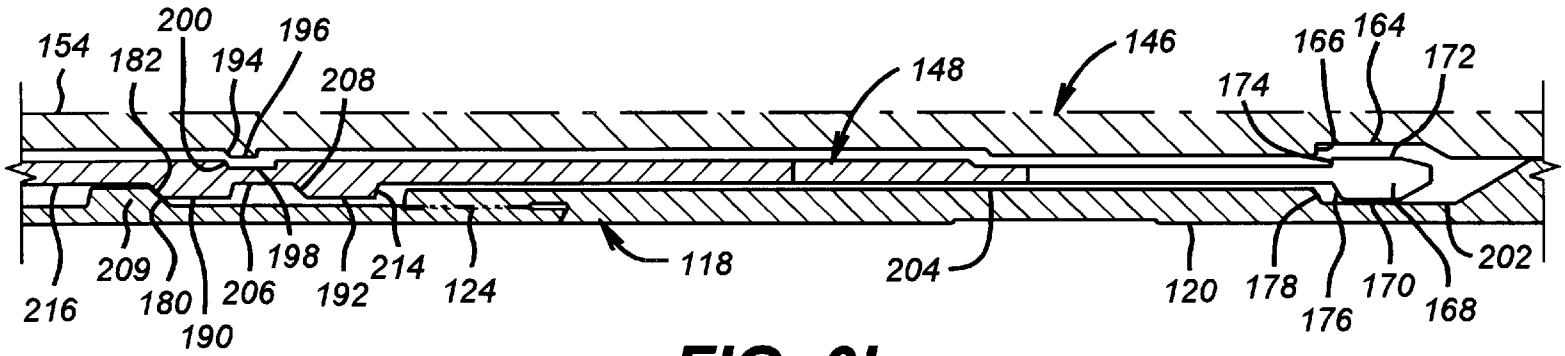
Figure 6C:
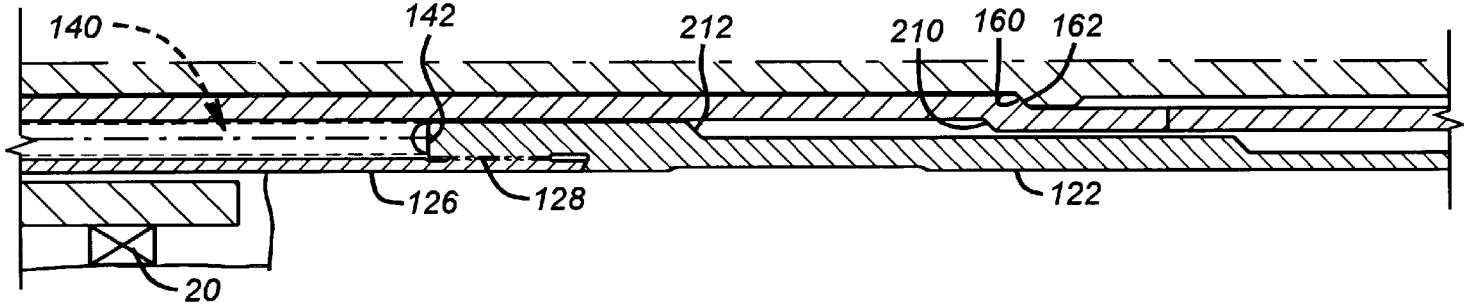
Figure 6D:
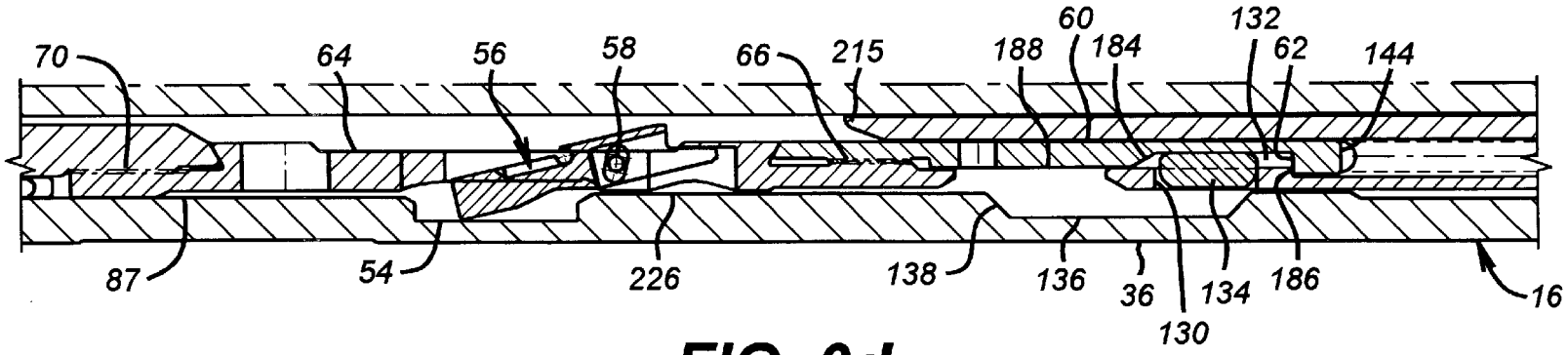
Figure 6E:
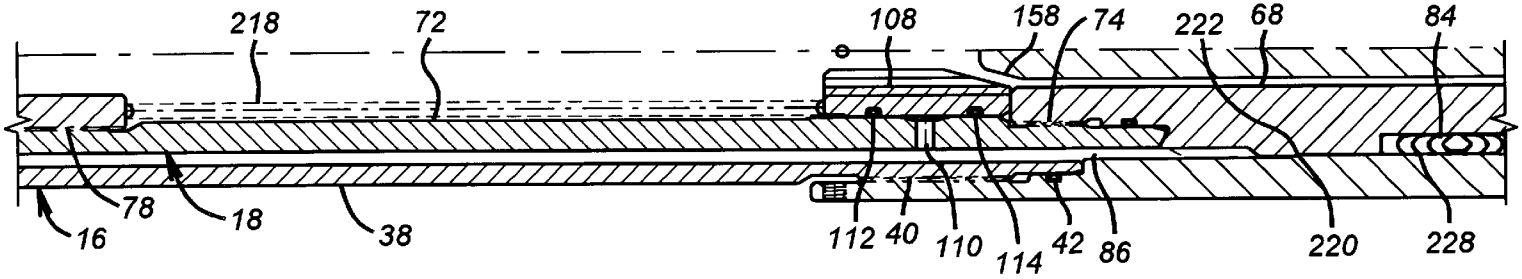
Figure 6F:
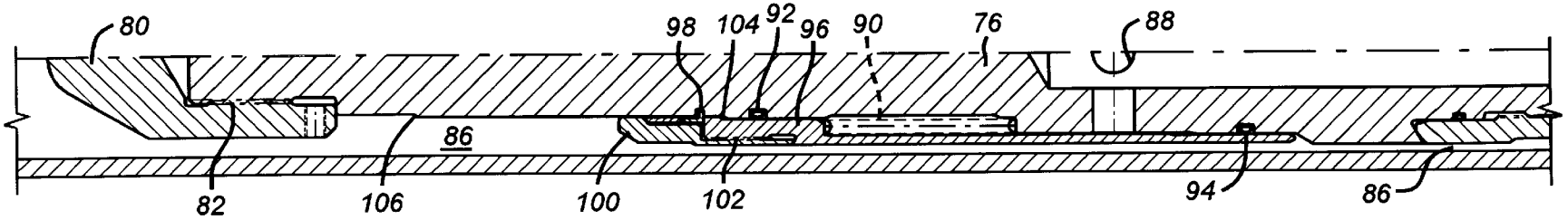
Figure 6G:
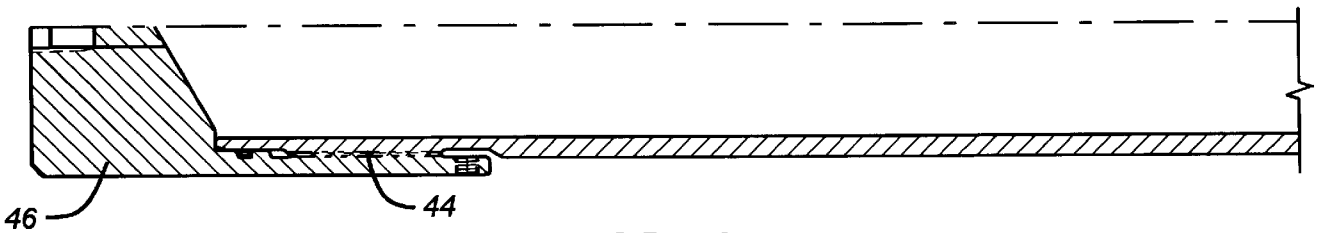

Referring now to FIGS. 6*c*–*g*, the nipple assembly 16 is shown in part. The upper end of the nipple assembly 16 has been removed for ease of view of the remaining portions of the assembly. However, for the purpose of completeness, the packer 20 is shown schematically in FIG. 6*c*. The nipple assembly 16 includes a top sub 36 connected to a body 38 at thread 40. Seal 42 seals the threaded connection at thread 40. Thread 44 is at the lower end of body 38. A test plug 46 can be used initially to test the sealing integrity of the nipple assembly 16. Once that test is complete, the plug 46 is removed from thread 44 and is replaced with an entry guide 48. Entry guide 48 has a taper 50 at its lower end. When the plug 18 is returned into the nipple assembly 16, the taper 50 helps to guide the plug 18 into the body 38. The entry guide 48 can be seen in FIG. 7*g*, while FIG. 6*g* shows the initial test plug 46 for pressure-testing at the surface. The nipple assembly 16 has a groove 54. The plug 18 has a rotating latch 56 which is biased into groove 54. Latch 56 pivots about pivot 58 and is biased counterclockwise to remain in groove 54 by a biasing member which is not shown.

The plug 18 comprises a top sub 60 which has a shoulder 62 which faces outwardly. The top sub 60 is engaged to the latch sub 64 at thread 66. Latch sub 64 is engaged to seal sleeve 68 at thread 70. Sleeve seal 68 is engaged to equalizing sleeve 72 at thread 74. Equalizing sleeve 72 is engaged to well-killing sub 76 at thread 78. Finally, cap 80 is secured to well-killing sub 76 at thread 82. The seal sleeve 68 shown in FIGS. 6*d*–*e* houses opposed chevron seals 84 to seal between surface 87 of the nipple assembly 16 and the plug 18 in both directions. Again, it should be recalled that the nipple assembly 16 is run into the wellbore with the entry guide 48 and is thus open at its bottom so that the pressure in the wellbore is communicated into an annular space 86. The plug assembly 18 is made of various components, as described, connected at various threaded locations and suitable seals are provided at the threaded connections to ensure the integrity of the plug 18.

Referring now to FIGS. 6*f* and *g*, the well-killing sub 76 has a port 88 that leads into variable volume cavity 90. Seals 92 and 94, in conjunction with piston 96 and well-killing sub 76, define the variable-volume cavity 90. In the run-in position illustrated in FIGS. 6*f* and *g*, the port 88 is covered by piston 96. The position of piston 96 is held in the position shown by virtue of shear ring 98. The shear ring 98 is assembled to the well-killing sub 76 via a sleeve 100 secured at thread 102. While a shear ring 98 is illustrated, shear pins can also be used as well as other devices that retain the piston 96 in position until a predetermined force in the variable-volume cavity 90 is exerted which causes the piston to move. Piston 96 has a shoulder 104 which ultimately catches on shoulder 106 of the well-killing sub 76 if the shear ring 98 is broken. The assembly just described is placed there for the reason that if a well-killing operation is necessary, flow through the plug 18 becomes important. Thus, if for any reason the plug 18 does not release from the nipple assembly 16 and pressure below it must be applied to kill the well if necessary, the piston 96 under those circumstances can be displaced to break the shear ring 98 to open the port 88 to allow flow through to below the plug assembly 18 to kill the well if required.

Figure 7A:
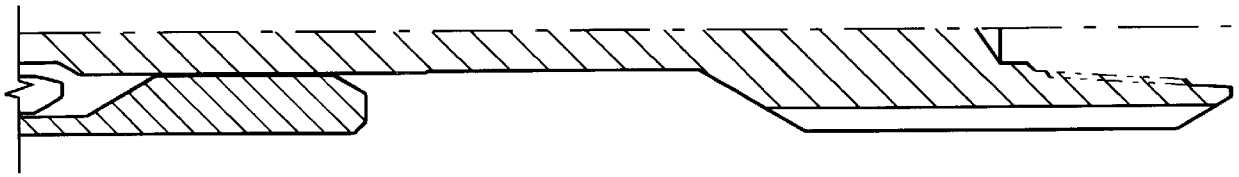
Figure 7B:
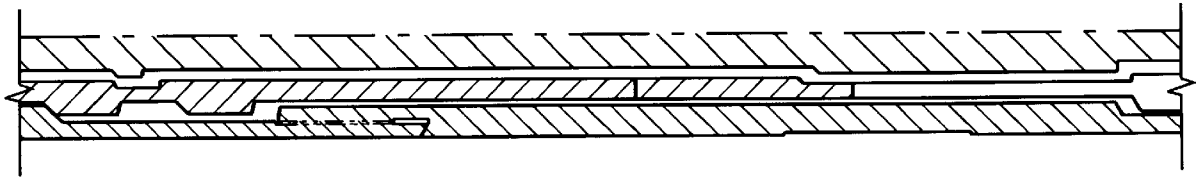
Figure 7C:
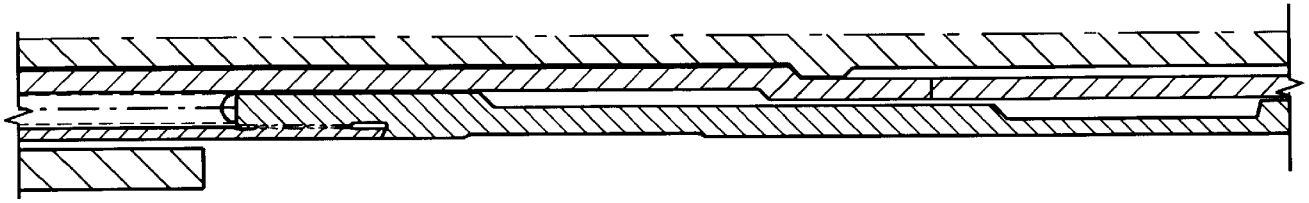
Figure 7D:
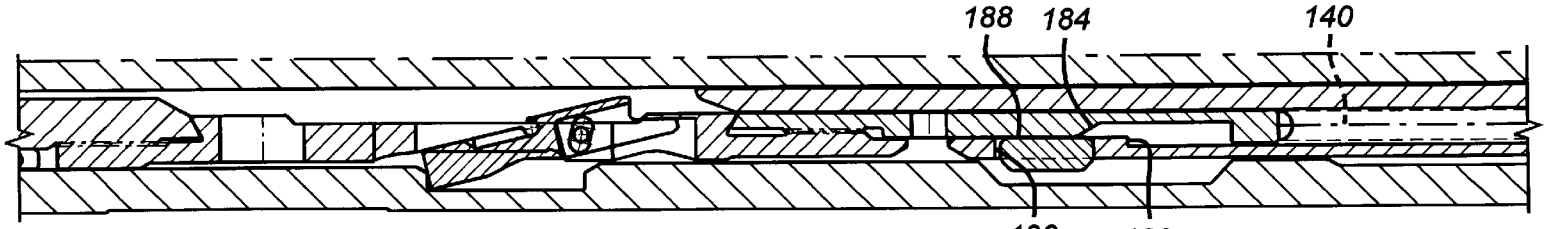
Figure 7E:
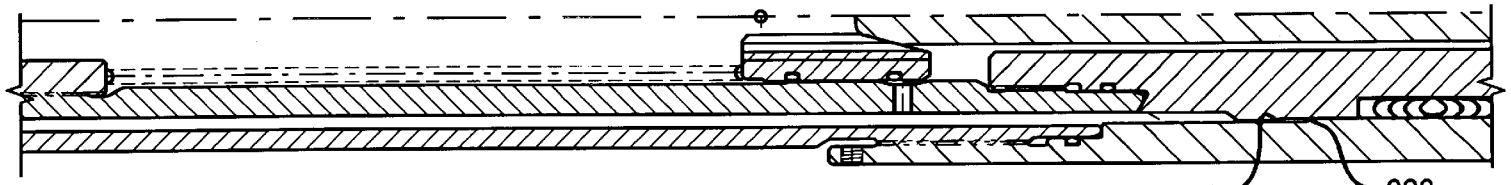
Figure 7F:
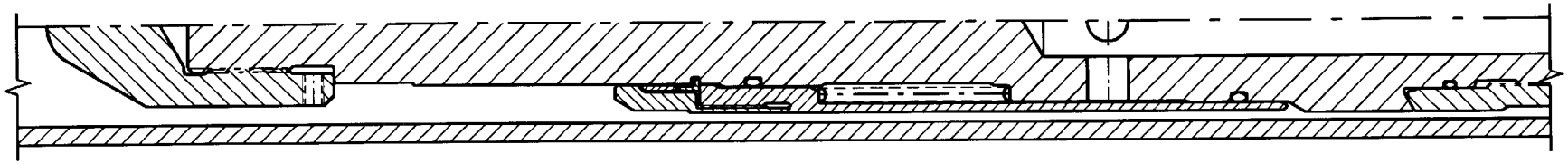
Figure 7G:
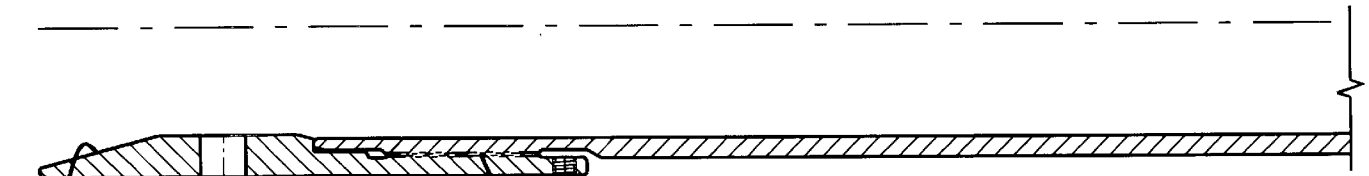

Another feature of the plug assembly 18 can be seen in FIG. 6*e*. A sleeve 108 straddles port 110 and seals 112 and 114 are found above and below the port 110 on sleeve 108. The sleeve 108 is ultimately displaced against spring 218, as seen in FIG. 7*e*, to equalize the pressure within the plug assembly 18 with the well pressure seen in annular space 86. As illustrated in FIG. 6*e*, the sleeve 108, once displaced by tapered surface 158, is poised to come back due to spring 218 which bears on top end 116 of well killing sub 76 if surface 158 is raised. This feature allows the assembly of the nipple 16 with plug 18 and packer 20 to be relocated in the well after packer 20 is released.

The outer sleeve 118 has a top sub 120 connected to a body 122 at thread 124. Bottom sub 126 is connected to body 122 at thread 128. Bottom sub 126 has a window 130 which during run-in as shown in FIG. 6*d* is aligned with a recess 132 adjacent to shoulder 62 of the top sub 60 of the plug assembly 18. A dog or dogs 134 straddle the window 130 and the recess 132. A bias on the dogs to that position is provided and not shown.

Figure 8A:
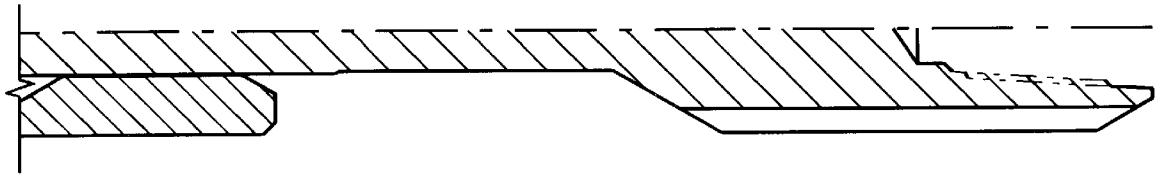
Figure 8B:
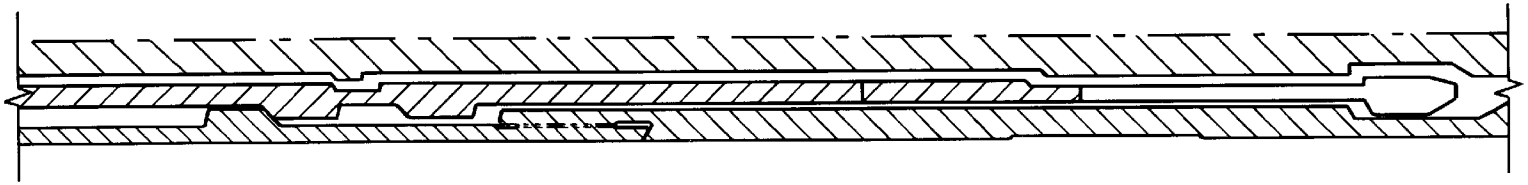
Figure 8C:
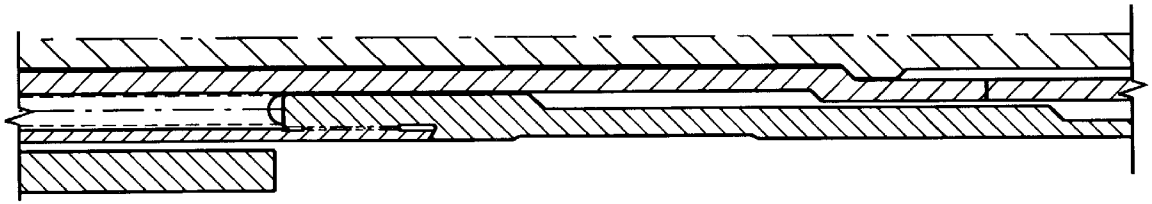
Figure 8D:
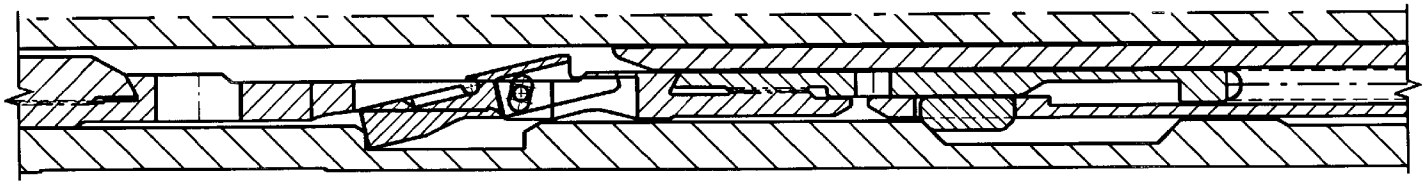
Figure 8E:
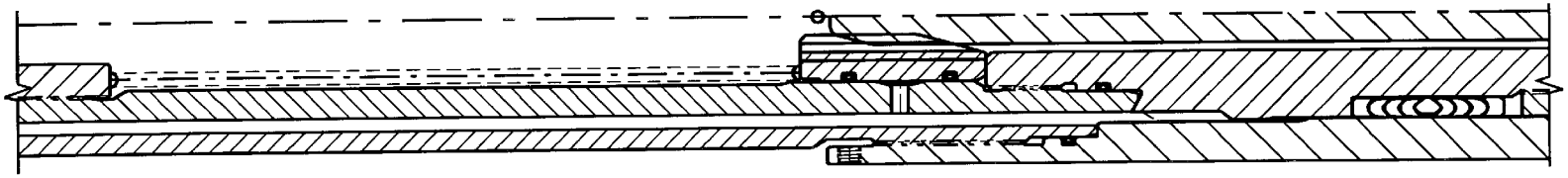
Figure 8F:
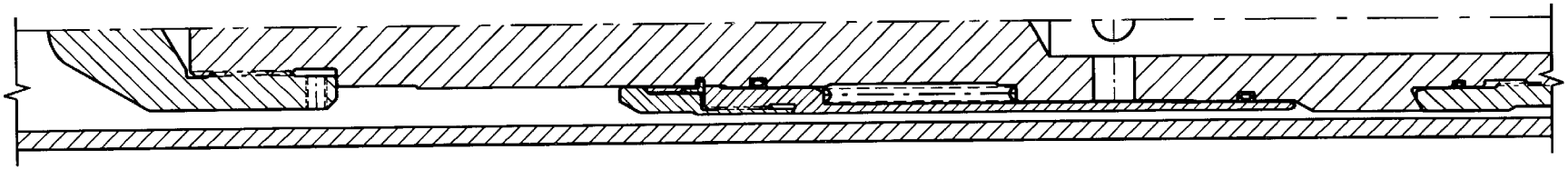
Figure 8G:
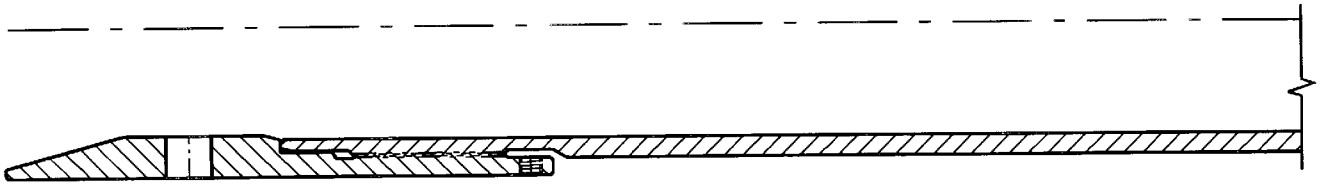

The nipple assembly 16 further comprises a recess 136, which has a sloping surface 138 which ultimately catches the dogs 134, as shown in FIG. 8*d*, thus precluding further relative movement between the outer sleeve 118 and the nipple assembly 16. The spring 140 bears against surface 142 of body 122 on one end and the top end 144 of top sub 60 at the other end. Those skilled in the art can see that a downward force applied to the outer sleeve 118 will compress the spring 140 as the outer sleeve 118 moves relatively to the plug assembly 18 which is held in place by pivoting latch 56. The packer 20 holds in place the nipple assembly 16.

The motion that initiates the compression of spring 140 is created by movement of the running tool 146 in conjunction with collet assembly 148. The running tool 146 (also shown as 32 in FIGS. 1–5) has a top sub 150 with a thread 152 to which the downhole assembly, such as the gun 30 shown in FIG. 3, can be attached. The running tool 146 is then composed of a body 154, which is connected at thread 156 to sub 150. Body 154 has a tapered surface 158 at its lower end as seen in FIG. 6*e*. The tapered surface 158 is used to displace the sleeve 108 for equalization using port 110 as previously described. The body 154 also has a tapered shoulder 160, which engages a mating shoulder 162 on the collet assembly 148. Thus, when weight is set down on the running tool 146, it pushes with it the collet assembly 148 due to the interaction of shoulders 160 and 162. The running tool body 154 has a recess 164 with an adjacent shoulder 166. The collet assembly 148 has a series of collet heads 168, each of which has an exterior surface 170, an interior surface 172, an inner shoulder 174, and an outer shoulder 176. Outer shoulder 176 is ramped along shoulder 178 of top sub 120 on the outer sleeve assembly 118. This interaction can be seen by examining FIG. 9*b*. Alternatively, when a pickup force is applied, the shoulder 166 on the running tool 146 catches the interior shoulder 174 on the collet heads 168 so that the running tool 146 moves in tandem with the collet assembly 148 as will be described below.

The collet assembly 148 has a shoulder 180 which engages with a shoulder 182 of the outer sleeve 118 in the run in position shown in FIG. 6*b*. Accordingly, when the running tool 146 is run in the well 10, shoulder 160 drives shoulder 162 as between the running tool 146 and the collet assembly 148. That force is in turn transmitted through the collet assembly 148 to the outer sleeve 118 through the engagement of shoulders 180 and 182. As a result of further advancement of the running tool 146, the sleeve 108 is displaced, allowing equalization through the plug assembly 18 through the passage 110. At the same time, the spring 140 is compressed. The reason this occurs is that the latch 56 prevents downward movement of the plug 18, while the running tool 146 and the collet assembly 148 move downhole in tandem due to the interaction of shoulders 160 and 162. With shoulder 180 pushing down on shoulder 182, the outer sleeve 118 is displaced with respect to the plug assembly 18. As a result, as best seen by comparing FIG. 6*d* with FIG. 7*d*, the window 130 has shifted from its initial alignment with recess 132. As a result, the dogs 134 have been ramped on taper 184 and the dogs 134 have moved into recess 136. Additionally, shoulder 186 has moved away from shoulder 62. Those skilled in the art will appreciate that shoulder 186 of the outer sleeve 118 retains the plug assembly 18 by virtue of the orientation of inwardly facing shoulder 186 and outwardly facing shoulder 62. Thus, for advancement of the plug assembly 18 out of the nipple assembly 16, the shoulder 186 will catch the shoulder 62 to retain the plug assembly 18. This procedure occurs much later.

Now reverting back to the initial steps involving a set down weight on the running tool 146, the spring 140 is compressed until the window 130 progresses sufficiently so that the dogs 134 become trapped in window 130 against sloping surface 138 and are held there by surface 188 of top sub 60 which is part of the plug assembly 18. That position is reached in FIG. 8*d*. It should be noted that at the time of the relative movement of the outer sleeve 118 with respect to the nipple assembly 16, the plug 18 is still latched, through latch 56, to the nipple assembly 16 at groove 54.

Figure 9A:
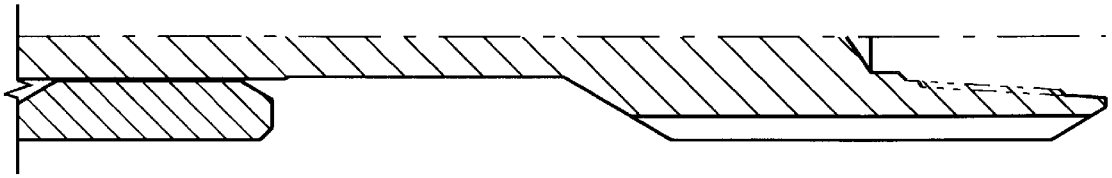
Figure 9B:
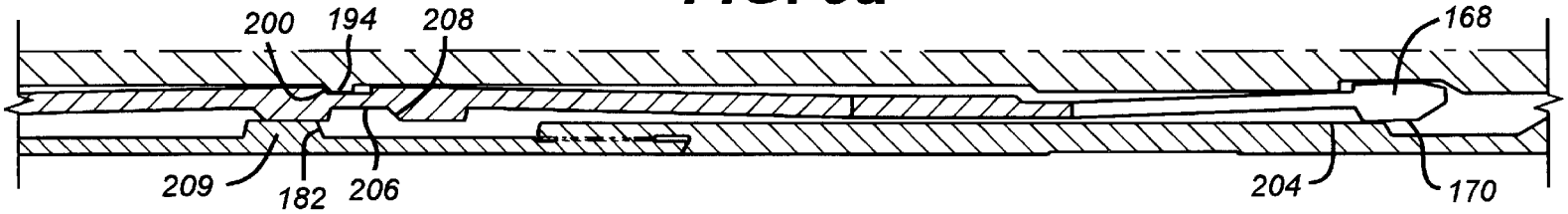
Figure 9C:
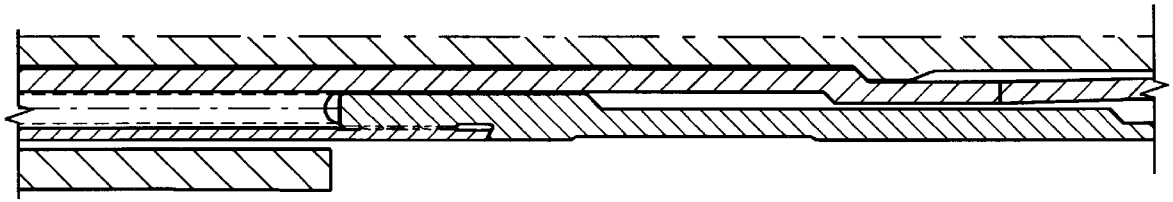
Figure 9D:
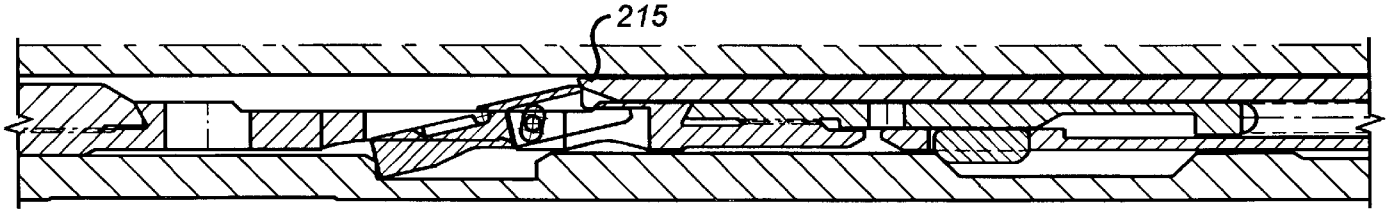
Figure 9E:
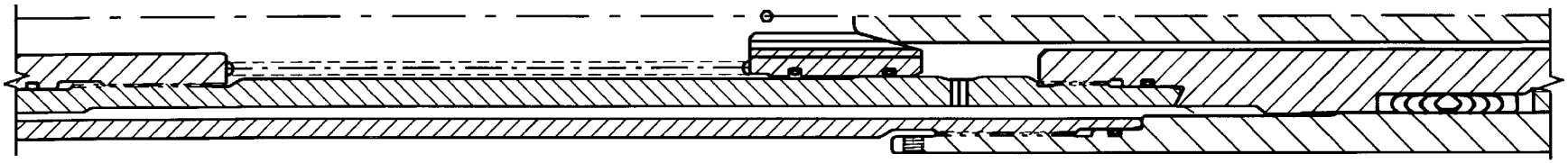
Figure 9F:
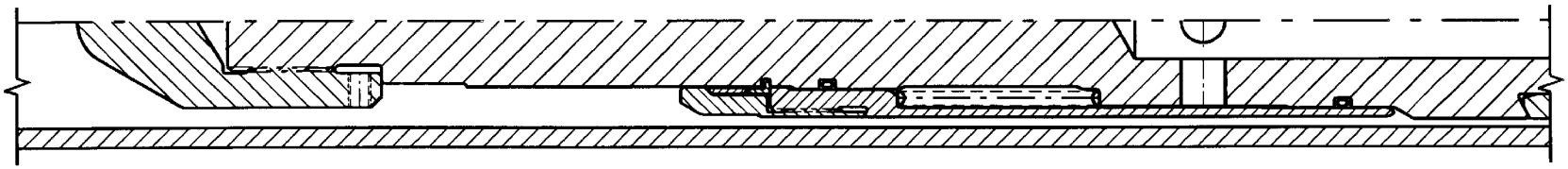
Figure 9G:
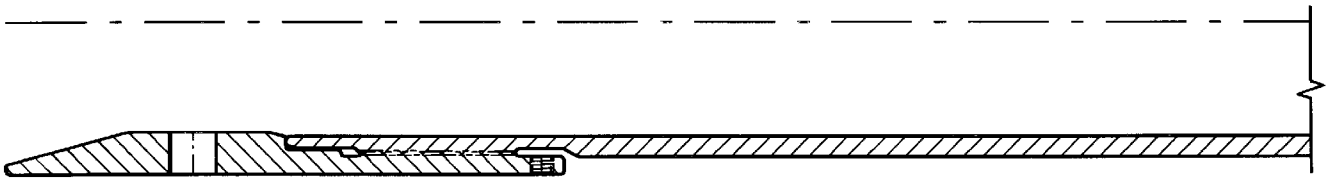

The collet assembly 148 is built sufficiently flexible so that a continuation of applied downward force on the running tool 146 will allow the sloping surface 180 to ride inwardly on sloping surface 182, as has been seen in comparing FIGS. 6*b*–9*b*. By the time sufficient force has been exerted on the running tool 146 to reach the position of 9*b*, the first of two raised surfaces 190 and 192 has cleared the sloping surface 182 of the outer sleeve 118. At that time, as shown in FIG. 9*b*, the running tool 146 has an external shoulder 194 adjacent a projection 196. As shown in FIG. 9*b*, when the shoulder 180 of the collet assembly 148 clears the shoulder 182, the projection 196 on the running tool 146 extends into groove 198 of the collet assembly 148. At that time, the interengagement between the projection 196 on the running tool 146 and the depression 198 on the collet assembly 148 allows the collet assembly to flex inwardly to accommodate further downward tandem movement of the running tool 146 with collet assembly 148.

While this is occurring, the collet heads 168 of the collet assembly 148 s have been ramped out of recess 202 on the outer sleeve 118 due to the interaction between shoulders 176 and 178. This is best shown in FIG. 9*b* where the collet heads 168 become trapped in recess 164 as surface 170 becomes supported by surface 204 of top sub 120. In the view shown in FIG. 9*b*, the collet heads 168 are trapped to recess 164 of the running tool 146. However, tandem movement of the running tool 146 and the collet assembly 148 continues.

Figure 10A:
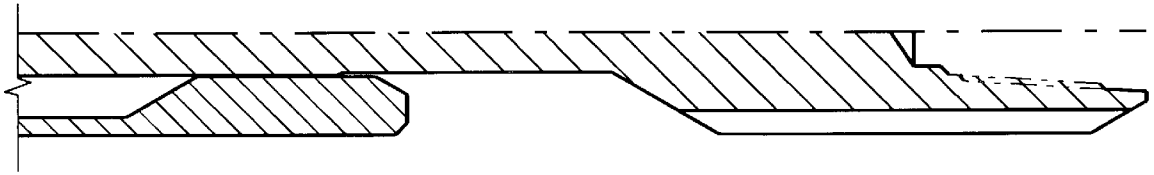
Figure 10B:
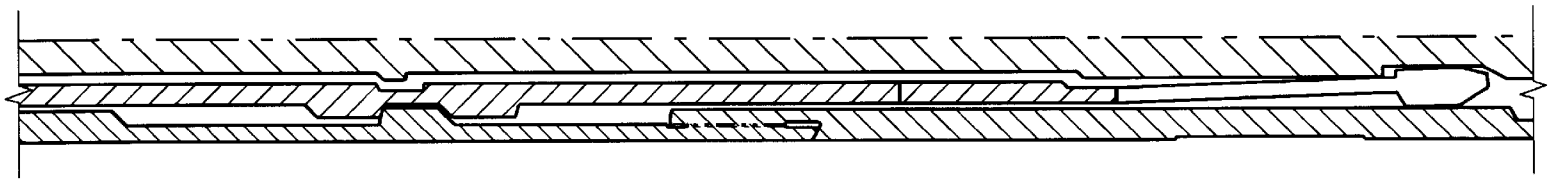
Figure 10C:
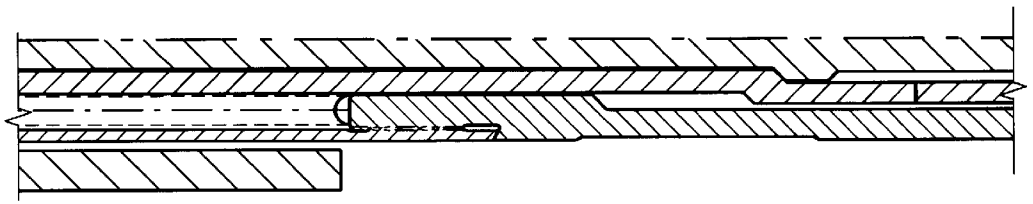
Figure 10D:
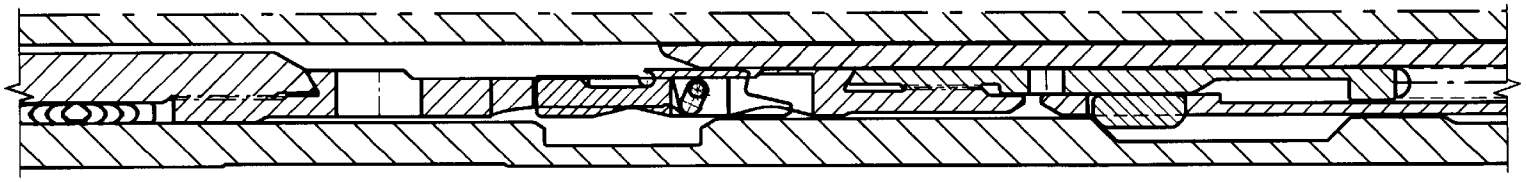
Figure 10E:
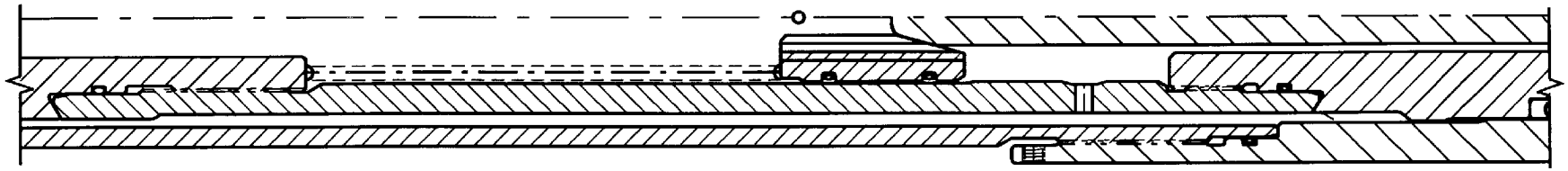
Figure 10F:
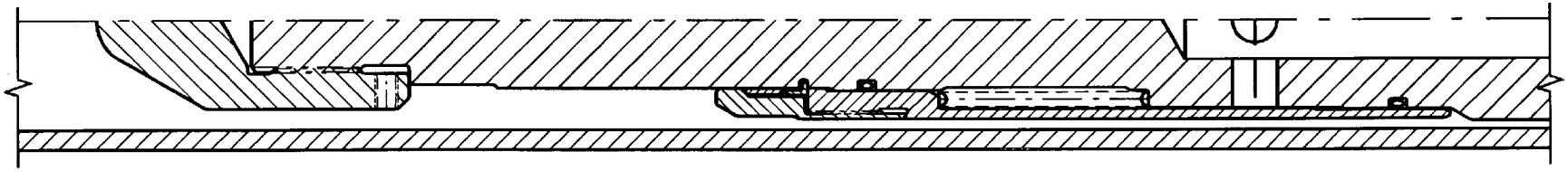
Figure 10G:
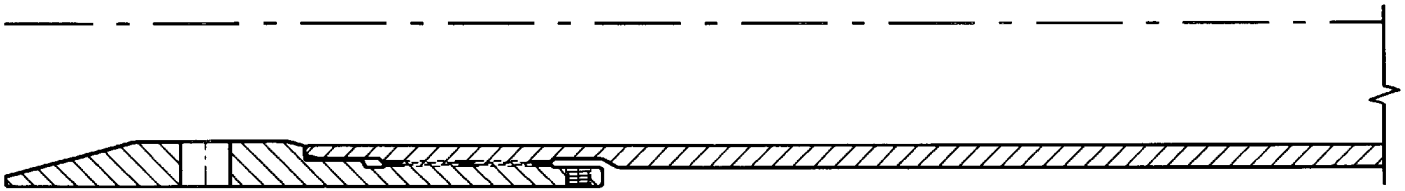
Figure 11A:
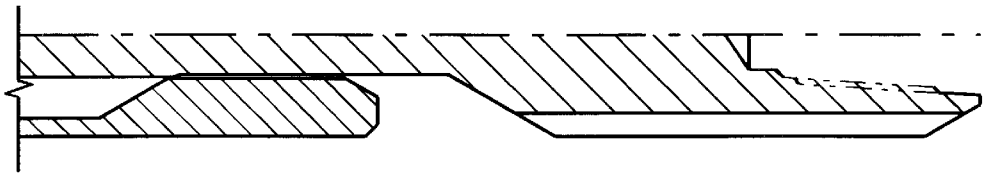
Figure 11B:
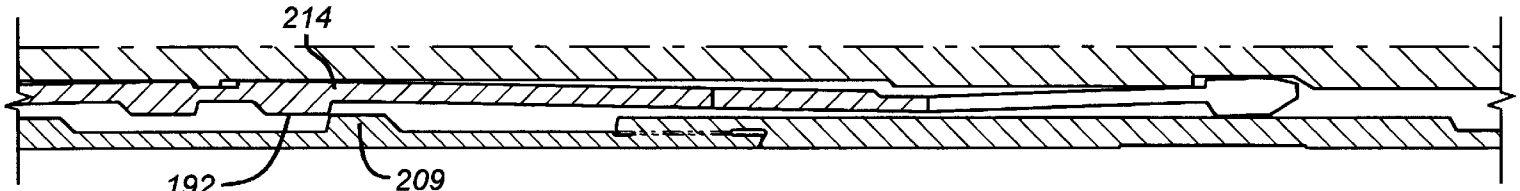
Figure 11C:
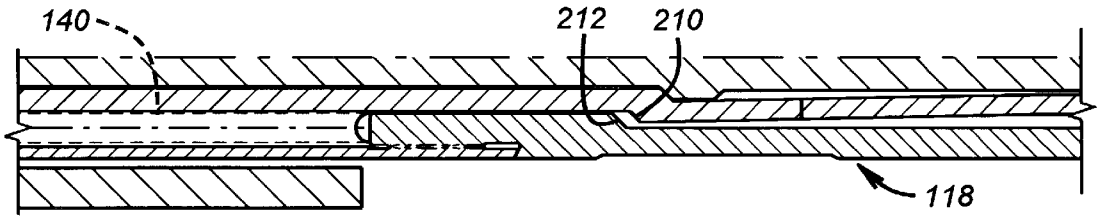

Downward motion of the running tool 146 moving in tandem with collet assembly 148 continues beyond the position shown in FIG. 9*b* until ultimately recess 206 presents itself over lug 209 on the outer sleeve 118, as shown in FIG. 10*b*. At the same time, groove 198 presents itself opposite projection 196 on the running tool 146. In this transition position, the outer sleeve 118 is trapped to the collet assembly 148 such that the spring 140 cannot push the outer sleeve 118 upwardly. Friction in seals 84 is such that its force exceeds the force of spring 140. However, the combined assembly of the running tool 146 and the collet assembly 148 can still progress downwardly to present tapered surface 208 against the tapered surface 182. As further set down weight is applied to the running tool 146, the collet assembly 148 moves with it and tapered shoulder 208 rides up to shoulder 182 until surface 192 of the collet assembly 148 clears pass the lug 209. The position illustrating surface 192 as it is about to pass lug 209 is shown in FIG. 11*b*.

Figure 11D:
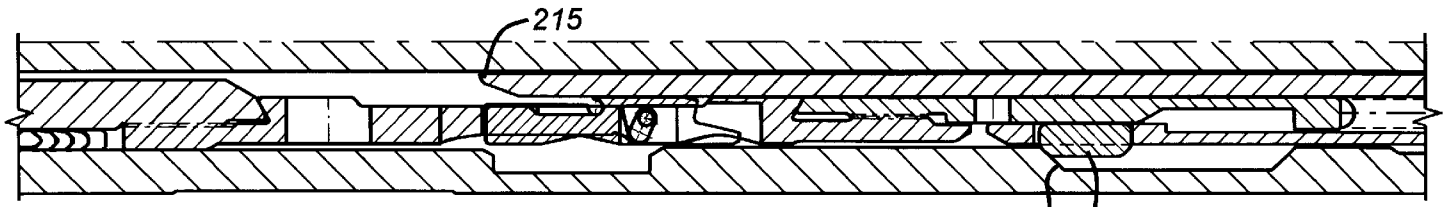
Figure 11E:
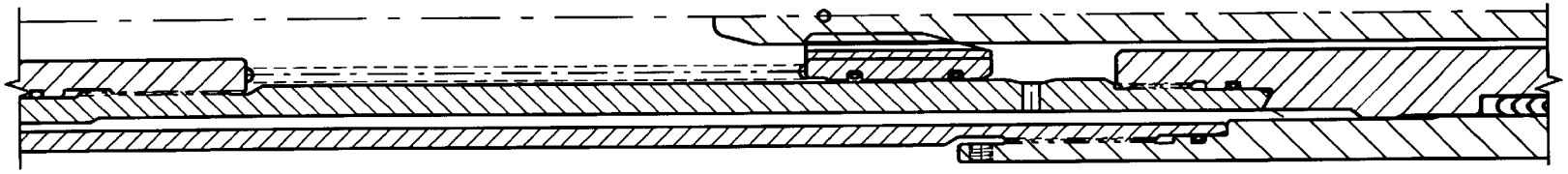
Figure 11F:
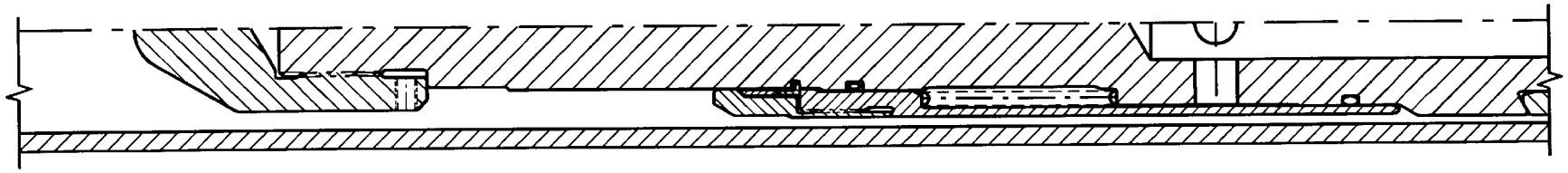
Figure 11G:
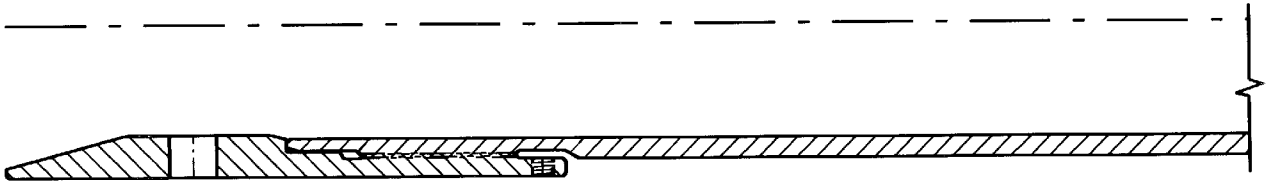
Figure 12A:
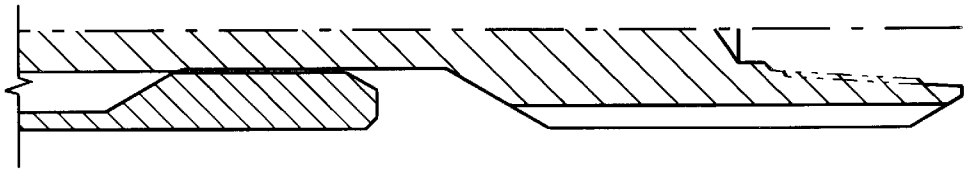
Figure 12B:
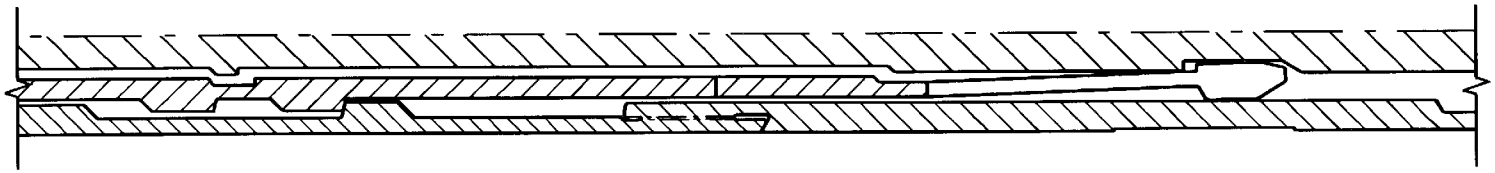
Figure 12C:
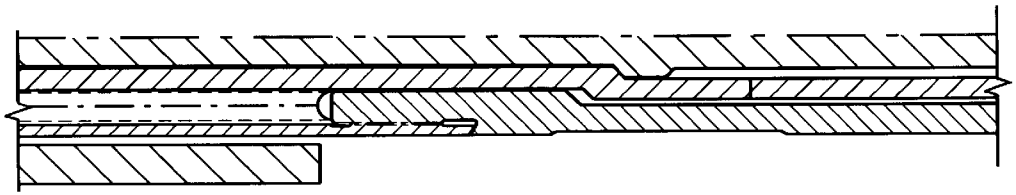
Figure 12D:
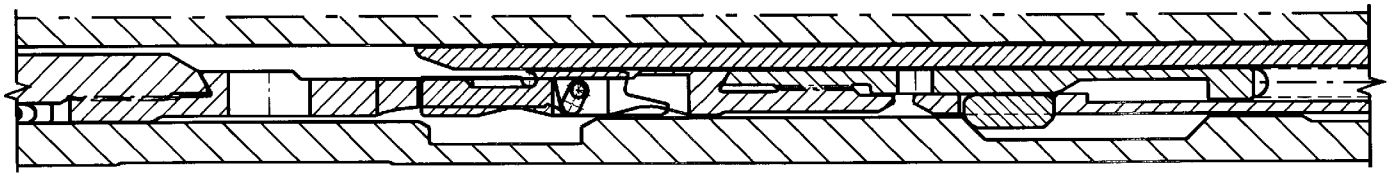
Figure 12E:
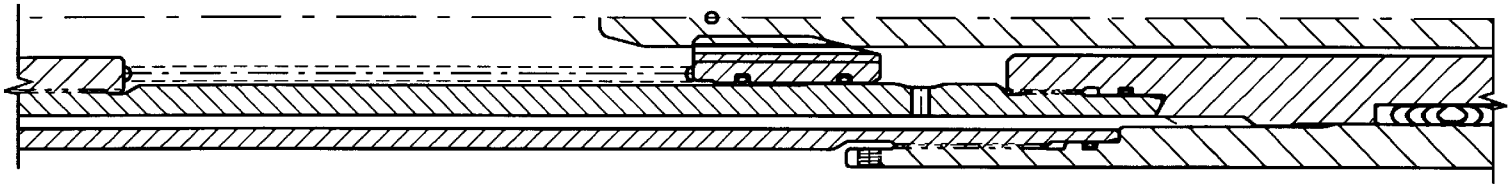
Figure 12F:
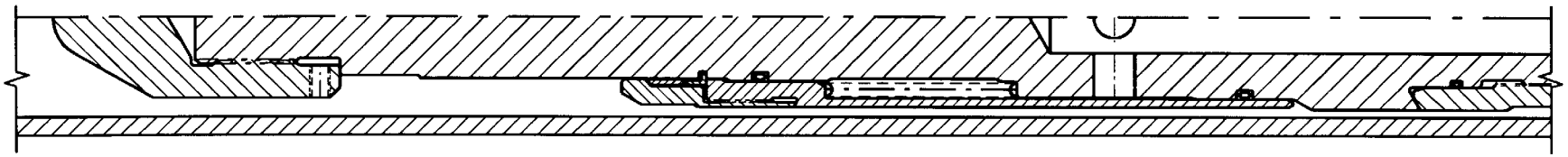
Figure 12G:
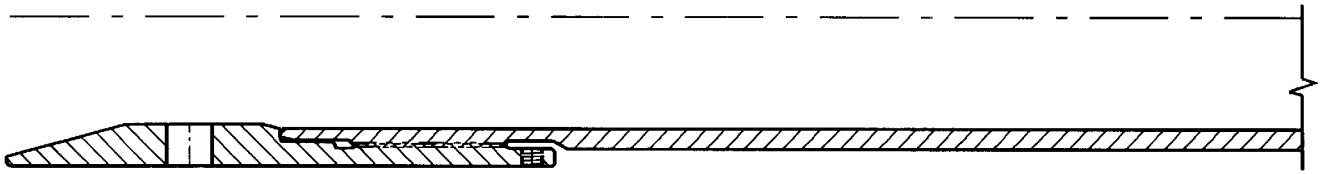
Figure 13A:
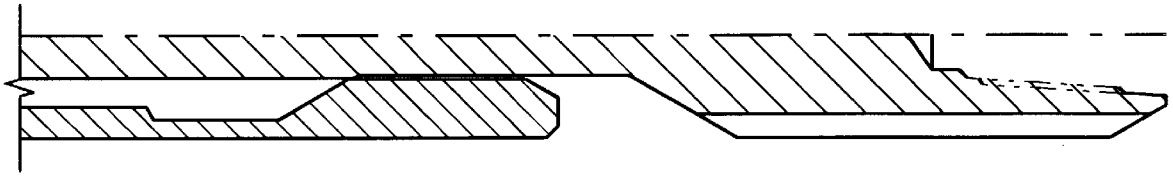
Figure 13B:
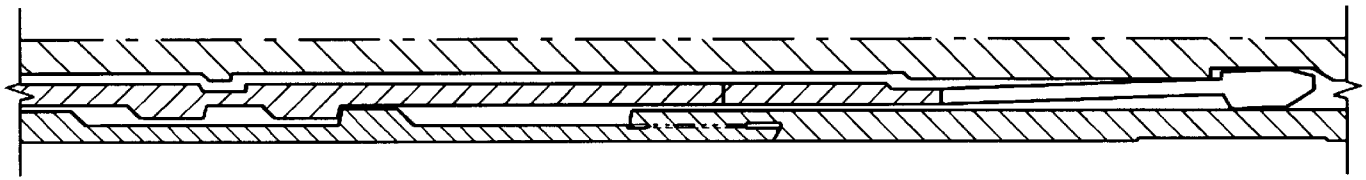
Figure 13C:
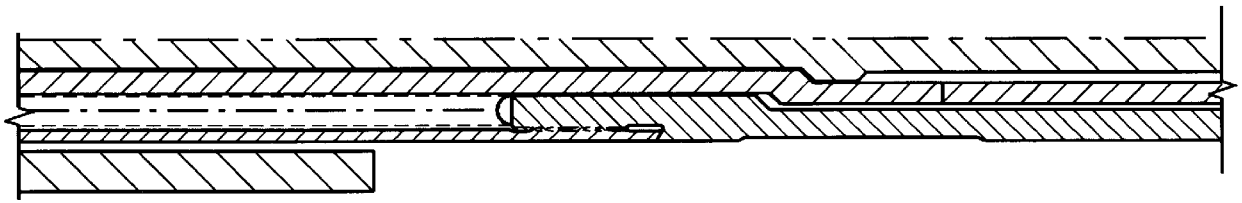
Figure 13D:
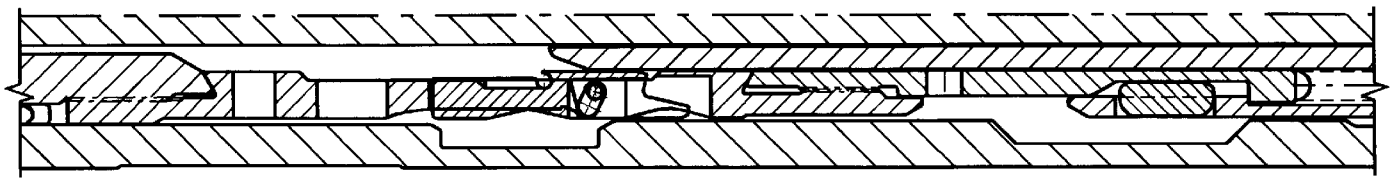
Figure 13E:
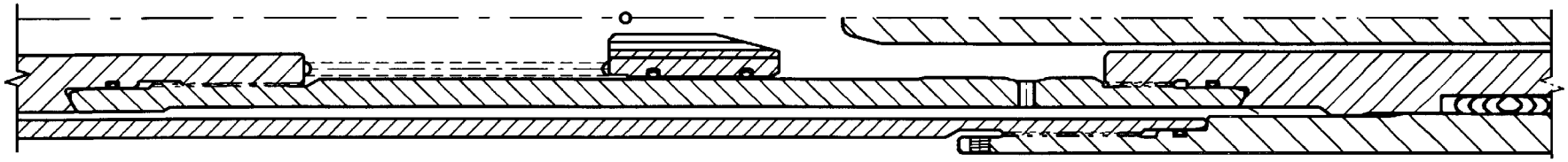
Figure 13F:
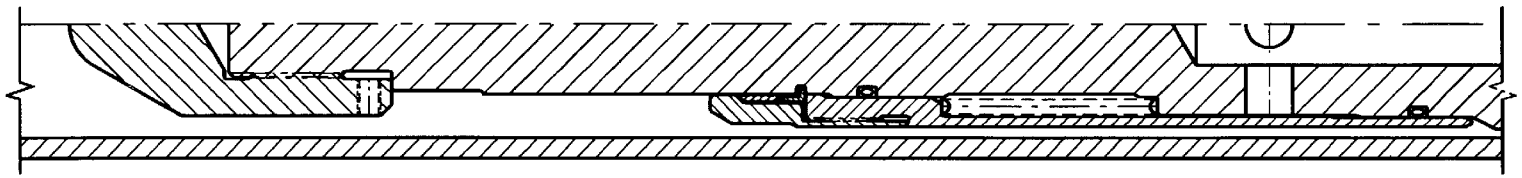
Figure 13G:
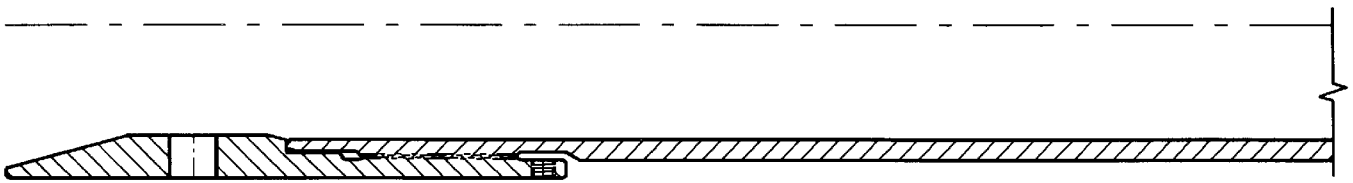

It should be noted that as the running tool 146 is pushed downwardly in tandem with collet assembly 148, the shoulder 210 on the collet assembly 148 has been moving closer to shoulder 212 on the outer sleeve 118. Additionally, the lower end 214 of the collet assembly 148 has been moving downwardly into the vicinity of the latch 56 so that by the time the position shown in FIG. 11*d* is reached, the latch 56 has been rotated clockwise to free the plug 18 from the nipple assembly 16. At this time, as shown in FIG. 11*d*, the outer sleeve 118 cannot move downwardly because the dogs 134 are still trapping the outer sleeve 118 against the nipple assembly 16 by virtue of engagement with sloping surface 138. The addition of set down weight on the running tool 146 now allows surface 214 on the collet assembly 148 to pass by lug 209 and enter recess 216. At this time, the collet assembly 148 prevents spring 140 from moving the outer sleeve 118 upwardly due to the close proximity of shoulders 210 and 212. When shoulders 210 and 212 connect, the weight indicator at the surface indicates that no further downward movement is achievable. At this point, the rotatable latch 56 has been turned out of groove 54. The spring 140 is selected to be of a strength which will not at this time drive the plug assembly 18 downwardly so as to bring shoulder 62 closer to shoulder 186 on the outer sleeve 118. This is because of friction in seals 84 resists such force. Such movement, when it does occur, results in a return of the dogs 134 to the position shown in FIG. 6*d*. However, such movement does not yet occur because after fully setting down weight on the running tool 146, so that no further weight indication is seen at the surface, an upward force is applied to the running tool 146 so as to engage shoulder 166 on the running tool with the shoulder 174 on the collet assembly 148. In addition, surface 214 on the upward pull to the running tool 146 is in engagement with lug 209 on the outer sleeve 118 and, therefore, brings up the outer sleeve 118 to bring shoulder 186 into contact with shoulder 62. The angle of contact between surface 214 and lug 209 is such that an upward pull on running tool 146 will not make surface 214 climb over lug 209. This upward pull then in turn brings up dogs 134 opposite recess 132. Thus, in the view shown in FIG. 13*d*, the dogs 134 have moved into alignment with recess 132, thus allowing the outer sleeve 118 to progress downwardly when the running tool 146 is then again lowered. The dogs 134 no longer are retained by the sloping surface 138 on the nipple assembly 16 on the subsequent trip down.

Thus, the sequence of motions is a set down weight on the running tool 146 which bottoms the outer sleeve 118 on sloping surface 138 of the nipple assembly 16. Further downward movement traps the collet assembly 148 to the running tool 146 at collet heads 186. Continuing downward movement results in flexing of the collet assembly 148 until ultimately surface 214 gets behind lug 209 which is about the time that the lower end 215 of the collet assembly 148 has contacted the pivoting latch 56 to force it out of groove 54. At this point, the chevron seals 84 in the plug 18 hold the plug in position with respect to the nipple 16, while at the same time the dogs 134 have trapped the outer sleeve 118 against any further downward movement with respect to the nipple 16. The subsequent pickup force has the purpose of unlocking the outer sleeve 118 from its locked position against the nipple 16 by virtue of dogs 134 being locked against sloping surface 138. The pickup force on the running tool 146 moves the dogs 134 opposite recess 132 on top sub 60 so that the outer sleeve 118 is no longer trapped by sloping surface 138. A subsequent downward movement allows the running tool 146 with the collet assembly 148 and the outer sleeve 118, which retains the plug 18, at surface 186, to all move downwardly through the nipple 16. To facilitate this downward movement, the running tool 146 holds the sleeve 108 against the bias of spring 218. As previously stated if for any reason the well needs to be killed, pressure is built up internally to the plug 18 through the running tool 146 so as to allow applied pressure to reach into the annulus 86 through passage 88.

Thus, if the tool assembled at thread 152 as shown in FIG. 6*a* is a perforating gun such as 30 shown in FIG. 3, the gun can now be placed at the desired location and fired through the opened subsurface safety valve 12. While this is occurring, the plug 18 is retained to the running tool 146. In order to get the gun 30, or other bottomhole assembly, back out after the downhole operation, the running tool 146 is picked up from the surface. The assembly is picked up until the shoulder 220 on the plug 18 contacts shoulder 222 on the nipple 16. These two shoulders are easier to see in FIG. 7*e* where they have separated from each other due to some slack available of the latch 56 in groove 54. Further upward movement of the running tool 146 pulls the collet heads 168 upwardly as shoulder 166 of the running tool 146 engages shoulder 174 of the collet heads 168. Ultimately, an upward force is put on the running tool 146 to make surface 214 of the collet assembly 148 jump over the lug 209 of the outer sleeve 118. Ultimately, sufficient upward movement of the assembly of the running tool 146 and the collet assembly 148 occurs for the lower end 215 of the collet assembly 148 to clear the latch 56. At this time, the latch 56 can rotate back into groove 54 to again secure the plug 18. The collet assembly 148 reaches the point where the collet heads 168 again come into alignment with the recess 202 on the outer sleeve 118. This is again the position shown in FIGS. 6*a*–g. At this time, the running tool 146 can be withdrawn and the port 110 is once again resealed as spring 218 biases the sleeve 108 so that seats 112 and 114 cover the port 110. This process can be repeated and the plug 18 can be reengaged with the running tool 146 to allow a variety of different assemblies to be put together in the wellbore without removing the nipple 16 or the plug 18 from the wellbore. At this time, a known release tool can be introduced to release the packer 20 and, if desired, retrieve the entire assembly of the nipple 16 and plug 18. In retrieving the plug 18 with the nipple 16, the sleeve 108 can move to allow port 110 to open so as to avoid having to pull up a column of liquid inside the retrieval string to the surface by allowing equalization.

The system as described above can be used as a retrofit on existing wells. If planned for during the initial completion, wireline nipples can be installed in the tubing string so that the nipple assembly 16 can be run on wireline into a seal bore in a wireline nipple already in the tubing string, thus doing away with the need for a packer such as 20. The wireline nipple has the standard features of allowing a nipple assembly such as 16 to seal up within its seal bore and lock to the wireline nipple.

Although the lower barrier is preferably the subsurface safety valve 12, a plurality of nipple assemblies such as 16 can be used if the plug in the upper assembly can pass through the nipple in the lower assembly. To do this, the upper plug would have its own running tool which would engage the lower plug.

Yet another feature of the present invention is the fact that surface 228, which is the seal bore for the chevron seals 84, has a larger diameter than the surface 226 immediately above the groove 54. The fact that the surface 226 is of smaller diameter helps centralize the equipment such as gun 30 after it is fired, when it is brought back into the nipple assembly 16. For example, if a gun is used in conjunction with the running tool 146 after the gun is fired, it will have burrs sticking out of it which if it was not centralized could affect the integrity of the seal bore which is surface 228. Accordingly, the diameter of surface 226 is made smaller to act as a centralizer.

The configuration of the outer sleeve 118 along with the dogs 134 and the way it interacts with surface 138 of the nipple 16 allows, in the event of an inadvertent dropping of the gun 30 and the running tool 146, a transfer of the kinetic energy directly to the nipple assembly 16 and to the slips in the packer 20 via dogs 134, which in that situation will come out into recess 136 and trap the falling components transferring their load to the slips in the packer 20.

The feedback feature of the apparatus and method is useful in letting surface personnel know that the plug has been effectively latched and released. Thus, when no weight is indicated at the surface, the running tool 146 has progressed to the point where it has pushed against the collet assembly 148, and the outer sleeve 118 has bottomed due to dogs 134 engaging surface 138 on the nipple assembly 16. When this indication is received at the surface, a pickup force allows the dogs 134 to come out of recess 136 so that a further set down will allow the plug 18 to clear the nipple assembly 16.

Another significant testing feature of the apparatus allows for an independent integrity test of the subsurface safety valve 12 and the plug 18 reseated in the nipple assembly 16. Thus, when the plug 18 is brought clear of the subsurface safety valve 12 but not yet in sealing engagement with the nipple assembly 16, the subsurface safety valve 12 can be closed and the wellbore 10 bled off at the surface to determine if the subsurface safety valve 12 is holding. If it is in fact holding, the well is then closed at the surface and the subsurface safety valve is opened while the plug 18 is raised into the nipple assembly 16 into sealing engagement. The well is again bled off at the surface to see if it will hold pressure. If that occurs, then the surface personnel know that the plug 18 has now fully reseated in the nipple assembly 16 and is functioning as a barrier. Thereafter, the subsurface safety valve 12 is closed again to provide the two barriers necessary to disassemble the bottomhole assembly with the running tool 32 as shown in FIG. 1, or 146 as shown in FIGS. 6–13, in the upper region 28 of the wellbore 10.

The advantages of the apparatus and method are that it can be easily retrofit to an existing well and the components can be run into place quickly with only a short lubricator. There is no need for a lubricator stack to be assembled on the rig which could be a 100 feet tall or more. The design is very simple in the sense that it does not involve a multiplicity of control lines that must be run to operate designs which have used multiple valves downhole. The nipple assembly 16 is relocatable in a variety of locations within the wellbore above the subsurface safety valve 12. Therefore, it is a more flexible system allowing for variation of the depth in the wellbore 10 to be used as the lubricator. Additionally, the design which allows the running tool 146 to grab the plug assembly 18 is simple with few moving parts and, hence, is more reliable. Additionally, the nipple assembly is removable after the downhole operation is concluded so that it does not remain in the wellbore to create any type of constriction for further downhole operations or well production. The configuration of the system allows for independent pressure-testing of the barriers against well pressure to ensure that the sealing integrity is maintained.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of assembly of a lengthy downhole tool in a live well for a downhole operation, comprising:

using a first isolation device in the well;

using a second isolation device in the well;

isolating an upper region in the well with said first and second isolation devices;

assembling the lengthy downhole tool assembly in the isolated upper region;

opening said isolation devices, with at least one being opened with said tool assembly;

running the tool assembly beyond said isolation devices; and performing the downhole operation.

2. The method of claim 1, further comprising:

closing with said downhole tool assembly said isolation device previously opened by it;

configuring said isolation device so that it is repeatedly capable of being operable by a downhole tool into the open and closed positions;

removing the downhole tool assembly from said upper region of the wellbore when both said first and said second isolation devices are in a closed position.

3. The method of claim 2, further comprising:

providing a removable valve member in said first isolation device;

providing a running tool with the downhole tool assembly; and engaging the removable valve member with the running tool.

4. The method of claim 3, further comprising:

providing a signal at the surface that the removable valve member is engaged by the running tool.

5. The method of claim 4, further comprising:

using a stopping of downhole advancement of the running tool into said removable member as a signal;

manipulating the running tool to allow release of the removable valve member; and moving said removable valve member with said running tool.

6. The method of claim 3, further comprising:

providing a seal around said removable valve member and within said first isolation device; and selectively equalizing pressure across said seal of said removable valve member to facilitate moving it.

7. The method of claim 6, further comprising:

providing a selectively opened port through said removable valve member to allow killing the well with pressure therethrough should said seat fail to operate.

8. The method of claim 3, further comprising:

providing as said first isolation device a nipple selectively sealingly engaged in the wellbore and having a seal bore therethrough;

using a plug as the removable valve member;

providing a seal on said plug engageable with the seal bore;

providing a latch to hold said plug in said seal bore; and manipulating the running tool to releasably lock into said plug and trip said latch.

9. The method of claim 8, further comprising:

using a collet assembly supported on an outer sleeve which is operably connected to said plug;

advancing said running tool until it connects with said collet assembly;

bottoming said outer sleeve to said nipple by advancing said collet assembly with said running tool; and receiving a signal that said plug is secured to the running tool when downhole travel of the running tool becomes selectively impeded.

10. The method of claim 9, further comprising:

using at least one locking dog in said outer sleeve to selectively stop downhole movement of the running tool by locking said outer sleeve to said nipple;

applying a pickup force to release said dog; and moving said plug in the well.

11. The method of claim 2, further comprising:

using a subsurface safety valve as said second isolation device;

bringing the downhole tool assembly uphole through said subsurface safety valve when in an open position;

closing said subsurface safety valve before closing said first isolation device with said downhole tool assembly; and depressurizing said upper region to test the functioning of the subsurface safety valve.

12. The method of claim 11, further comprising:

opening said subsurface safety valve when said downhole tool assembly has closed said first isolation device to test the sealing function of said first isolation device.

13. The method of claim 1, further comprising:

using a subsurface safety valve as said second isolation device;

running in said first isolation device and sealingly securing it externally in the wellbore;

sealingly securing a plug internally to said first isolation device; and using the downhole tool assembly to manipulate said plug into and out of sealing contact within said first isolation device.

14. The method of claim 2, further comprising:

removing said first isolation device by itself from the wellbore after said removal of the downhole tool assembly.

15. The method of claim 10, further comprising:

providing a seal around said removable valve member and within said first isolation device; and selectively equalizing pressure across said seal of said removable valve member to facilitate moving it.

16. The method of claim 7, further comprising:

providing a selectively opened port through said removable valve member to allow killing the well with pressure therethrough should said seal fail to operate.

17. The method of claim 16, further comprising:

using a subsurface safety valve as said second isolation device;

bringing the downhole tool assembly uphole through said subsurface safety valve when in an open position;

closing said subsurface safety valve before closing said first isolation device with said downhole tool assembly; and depressurizing said upper region to test the functioning of the subsurface safety valve.

18. The method of claim 17, further comprising:

opening said subsurface safety valve when said downhole tool assembly has closed said first isolation device to test the sealing function of said first isolation device.

19. The method of claim 13, further comprising:

repositioning said first isolation device in the wellbore without removing it from the wellbore.

20. The method of claim 1, further comprising:

running in a wireline nipple having a seal bore as part of a tubing string;

providing as a part of said tubing string a subsurface safety valve as said second isolation device;

running in as said first isolation device a nipple assembly with an external seal engageable in said seal bore;

selectively sealingly securing said nipple in said seal bore;

sealingly mounting a removable member in said nipple; and manipulating said member out and into said sealing engagement with said nipple by using said downhole tool assembly.

* * * * *